US005089960A

United States Patent [19]

Sweeney, Jr.

[11] Patent Number: 5,089,960

[45] Date of Patent: Feb. 18, 1992

[54] RACING SYSTEM FOR EXERCISE MACHINES

[75] Inventor: James S. Sweeney, Jr., Laguna Beach, Calif.

[73] Assignee: Laguna Tectrix, Inc., Irvine, Calif.

[21] Appl. No.: 482,227

[22] Filed: Feb. 16, 1990

[51] Int. Cl.[5] ..... G01L 5/02; G06C 15/44

[52] U.S. Cl. ..... 364/410; 434/61; 272/93

[58] Field of Search ..... 364/410; 128/668, 670, 128/662; 272/97, 69, 72, 73; 434/61, 253

[56] References Cited

U.S. PATENT DOCUMENTS

| | | | |
|---|---|---|---|
| 4,196,528 | 4/1980 | Foerst | 434/61 |
| 4,408,613 | 10/1983 | Relyea | 128/670 |
| 4,542,897 | 9/1985 | Melton et al. | 128/668 |
| 4,579,335 | 4/1986 | Centafanti | 272/69 |
| 4,906,192 | 3/1990 | Smithard et al. | 272/97 |
| 4,919,416 | 4/1990 | DeCloux | 272/69 |
| 4,976,424 | 12/1990 | Sargeant et al. | 272/73 |

OTHER PUBLICATIONS

"Transtelephonic for Remote Cardiac", Medical Electronics June 1987, Jane Howard M.D. Dennis Hepp.

*Primary Examiner*—Gail O. Hayes

*Attorney, Agent, or Firm*—Thomas J. Plante

[57] ABSTRACT

A racing system for a group of exercise machines is disclosed. The race is entirely flexible, in that each exercise unit communicates electronically with all of the other potential racing units. Any user may offer a race, accept or reject another user's race offer, or join a race during a limited countdown period. More than one race can be underway. For cost reduction, a daisy chain hookup is used, in which each unit's microprocessor has an input port receiving message flow from the output port of the preceding unit, and an output port transmitting message flow to the input port of the following unit. The racing function is controlled by the same microprocessor which is embedded in each exercise machine as the controller for that machine, receiving commands from the user and feedback from the machine.

25 Claims, 8 Drawing Sheets

RACING SYSTEM FOR EXERCISE MACHINES

BACKGROUND OF THE INVENTION

This invention relates to machines used for exercising, and particularly to an electronic system which permits users of a plurality of such machines to race one another. The invention was developed for use with machines which simulate stair climbing; but it is also applicable to cycling machines, treadmills, rowing machines, etc.

The racing concept provides a useful motivator for users of exercise equipment. Users generally have predetermined goals to reach in working out on such machines. Often, the machines provide visual indicators which compare the user's accomplishment to pre-established goals. The use of racing between or among users constitutes a competitive means of motivating user effort.

In prior racing systems for exercise machines, dedicated systems have been used.. A group of machines has been connected into a racing network, which is usable only for racing until the network has been disconnected.

Another limitation of prior racing systems has been the need for specialized computer equipment to handle the racing function.

The present invention is directed toward the advantages of a racing system which (a) is readily incorporated into the computer hardware already included in the exercise equipment so that the racing function is always available and (b) is very flexible in permitting the user of each machine in a group to elect to participate or not participate in a race, without interfering with other users. Major benefits of such a racing system are low cost and maximum user freedom.

SUMMARY OF THE INVENTION

The present invention utilizes the microprocessor which is part of each exercise unit to provide the necessary intercommunication between several exercise units in a racing network. The racing function is incorporated in the software which also controls and monitors the individual exercise machine. The computer in each machine of a group of machines is so connected that it can function as part of a racing network. The simplest, but not always preferred, interconnection network is a daisy chain linkage.

An important aspect of the present invention is the electronic communication system, which permits any user in the network of machines to suggest the terms of a proposed race, and permits every other user to accept or not accept such terms. When any two users agree on the terms of a race, the other users in the network have a limited time to join that race. If they do not choose to join, their exercise is not affected in any way. And they may elect to participate in separate races, which may proceed concurrently.

BRIEF DESCRIPTION OF THE DRAWINGS

FIG. 11 showing the display as it appears in the racing mode.

DETAILED DESCRIPTION OF A SPECIFIC EMBODIMENT

Figure 1:
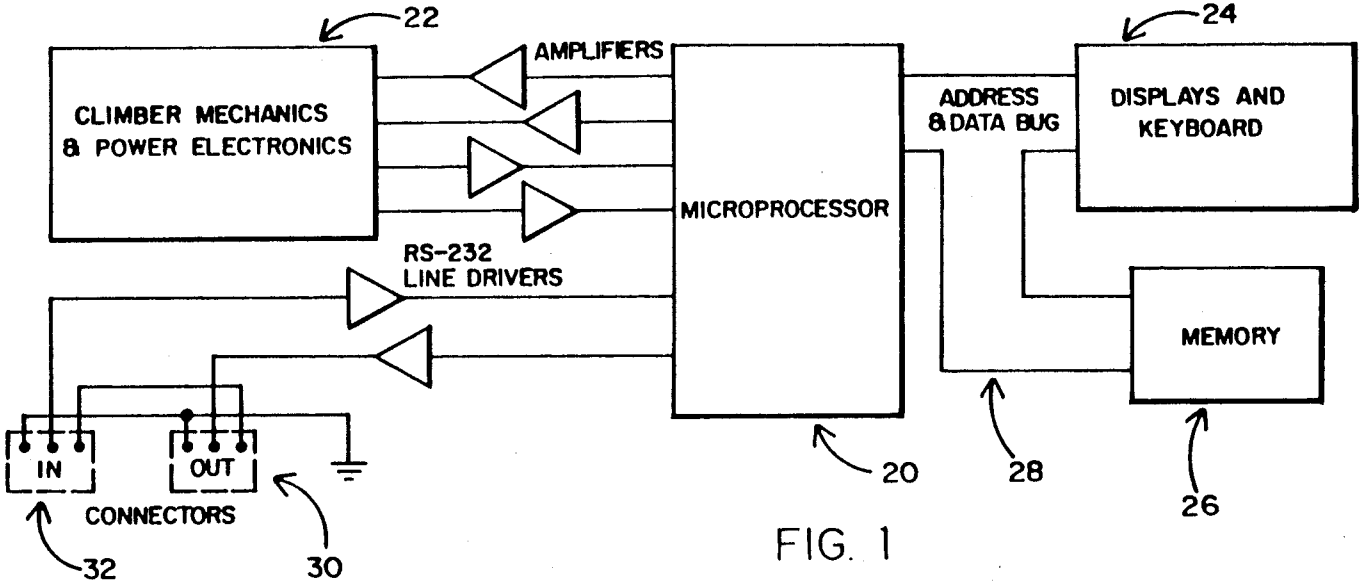
FIG. 1 is a block diagram of the electronic system of an exercise machine.

FIG. 1 shows a block diagram of the electronic system of a computer controlled exercise machine. A microprocessor 20 is arranged to control an exercise machine, indicated by the rectangle 22, in which the words "Climber Mechanics and Power Electronics" are included. However, as stated above, any type of exercise machine which permits competitive operation may be used. An example of a Climbing Machine with which the present invention has been used is the apparatus disclosed in common assignee Application Ser. No. 289,563, filed Dec. 23, 1988.

The microprocessor 20 is normally located in the front panel of the apparatus, which contains displays and a keyboard, and is indicated at 24. Microprocessor 20 communicates with the display, keyboard, and a memory 26 by means of an address and data bus 28.

The electronic communication between microprocessor 20 and exercise machine 22 is, of course, two-way communication, providing command control signals from the microprocessor to the exercise machine, and feedback signals form the exercise machine to the microprocessor. Each machine also has communication with other machines in a serially connected group. Signals from each microprocessor, on their way to the next machine, leave via an output port 30; and signals into each microprocessor, from the preceding machine, enter via an input port 32.

Figure 2:
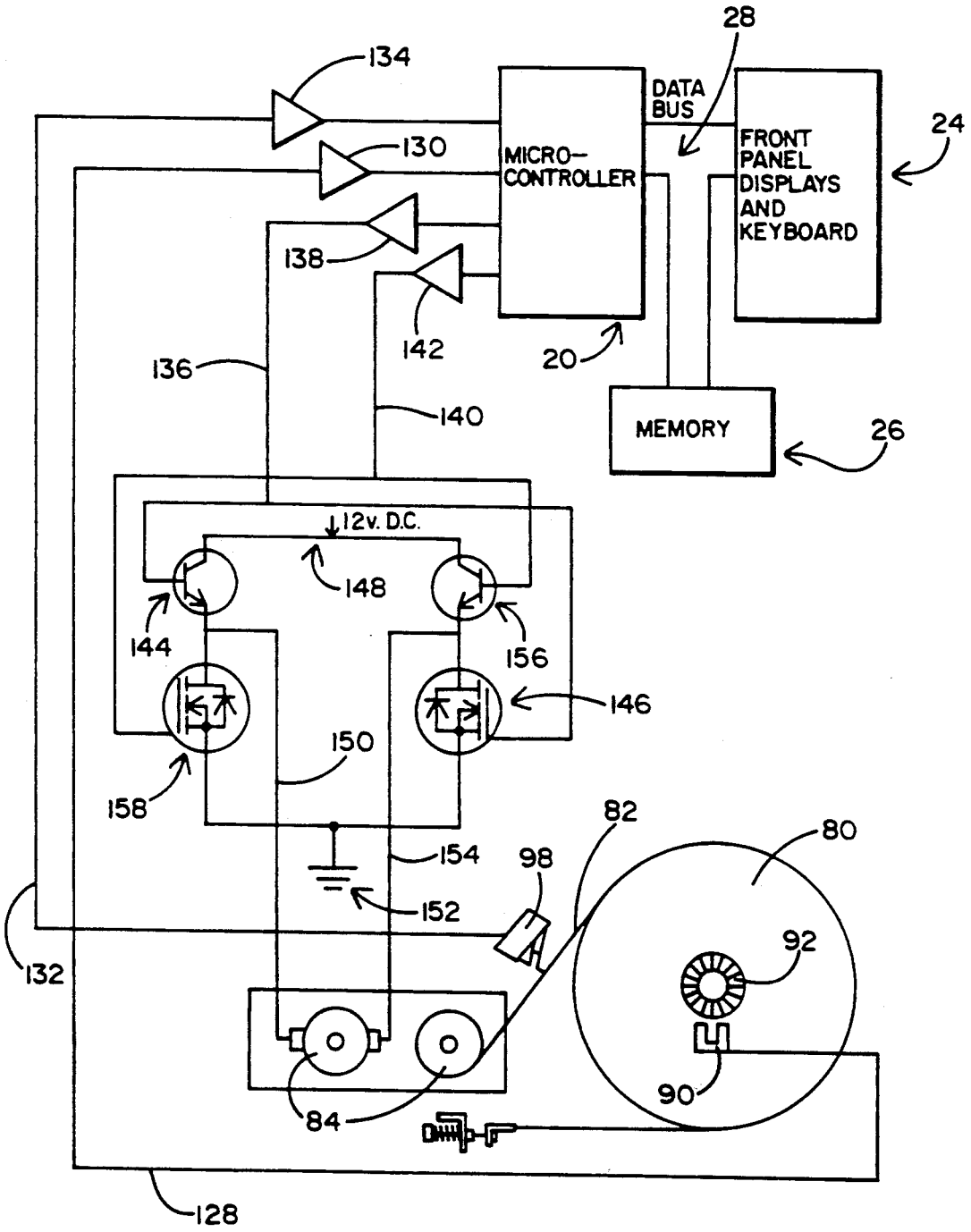
FIG. 2 is a block diagram copied from Application Ser. No. 289,563, in which the electronic system of a stair climber is diagrammed.

For completeness of description, FIG. 2 is included. It is substantially identical with FIG. 5 of Application Ser. No. 289,563, which discloses an electronic system for controlling the speed of an exercise apparatus, such as a stair climber. The microprocessor 20, displays and keyboard 24, memory 26, and bus 28 are similar to those shown in FIG. 1. As stated in Ser. No. 289,563, the front panel 24 provides both a display which supplies information to the user, and a keyboard which permits the user to enter command selections. The primary command is the desired speed of operation. This speed may remain at a selected level, or it may be varied in accordance with an automatic program.

The microprocessor 20, in addition to receiving the command signals, receives two types of feedback signals from the moving portions of the stair climber. A flywheel speed signal is directed to the microprocessor on line 128, after being amplified at 130. This signal is provided by an optical sensor 90 cooperating with an encoder disk 92 mounted on a flywheel 80. In the microprocessor 20, this speed signal feedback, representing actual speed, is compared with the command signal, producing an error signal which is used to control a gear motor 84, which is shown in duplicate in FIG. 2, in order to show separately its electrical connections and its connection to a band brake (belt) 82. Another sensing device is a slack sensing switch 98 connected by a line 132 through an amplifier 134 to microprocessor 20.

The control signals sent by microprocessor 20 to motor 84 are preferably pulsed signals having variable pulse widths. Signals to the motor 84 to tighten belt 82 on flywheel 80 follow a line 136, after amplification at 138. Signals to motor 84 to loosen belt 82 on flywheel 80 follow a line 140, after amplification at 142. A pulsed signal on line 136 enables a bipolar transistor 144 and a MOSFET transistor 146, in order to connect the left side of motor 84 to a voltage source 148 via line 150, and to connect the right side of motor 84 to ground 152 via line 154. This causes motor 84 to turn in a clockwise direction, tightening belt 82. A pulsed signal on line 140 enables a bipolar transistor 156 and MOSFET transistor 158, in order to connect the right side of motor 84 to voltage source 148 via line 154, and to connect the left side of motor 84 to ground 152 via line 150. This causes motor 84 to turn in a counterclockwise direction, loosening belt 82.

This brief description of the stair climber electronics is used only to increase clarity, and is not intended to have any limiting effect on the scope of the invention, which is broadly available for various types of exercise machines.

The electronic system of an exercise machine is often isolated, i.e., it is not designed to have communication with other exercise machines, or with a "host" unit. A host unit is a separate computer, which may be used to record and display information from one or more exercise machines. In order to permit connection to such a host unit, if desired, and also to permit connection in a racing network of exercise machines, serial communications ports are provided at each microprocessor 20, an "input" port for receiving data from other computers, and an "output" port for transmitting data to other computers. It is convenient to use standard serial communications hardware (EIA RS-232C). The microprocessor 20 of each exercise unit may be hardware selected from the Intel 8051 family, which has serial communications hardware built in. The microprocessor's 5 volt signals are conveniently converted to +12 volt RS-232 signal levels, using a Maxim MAX232 integrated circuit.

Figure 3:
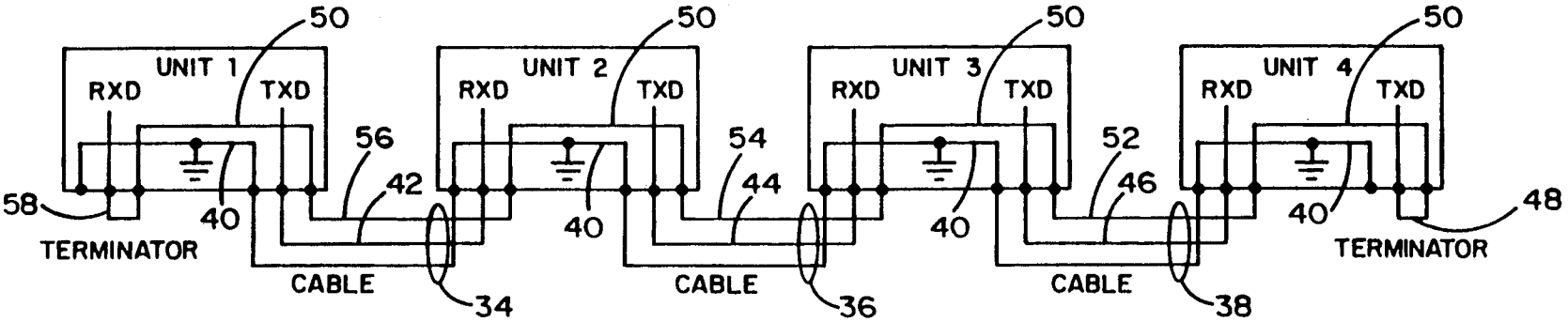
FIG. 3 is a block diagram of a cable hookup among a plurality of exercise machines.

FIG. 3 shows a block diagram having four exercise units (designated 1, 2, 3 and 4) connected in a daisy chain racing hookup. Theoretically, any number of exercise units may be included in such a network, but communication time could become excessive. Eight units are probably a logical network size.

In FIG. 3, the designation "TxD" indicates the transmitting (output) port of each unit, and the designation "RxD" indicates the receiving (input) port of each unit. A first cable 34 connects Units 1 and 2. A second cable 36 connects Units 2 and 3. And a third cable 38 connects Units 3 and 4. Use of "Terminator" plugs at Units 1 and 4, combined with "dummy" lines in each Unit, avoids the necessity of a fourth cable connecting Unit 4 to Unit 1. This may be a significant advantage in an exercise machine network in which the first and last machines are separated by a substantial distance.

As shown in FIG. 3, a single, cable-included line 40 serves as the grounding connection for the input and output ports of all four units. The transmitting port of Unit 1 is connected by cable line 42 to the receiving port of Unit 2. The transmitting port of Unit 2 is connected by cable line 44 to the receiving port of Unit 3. The transmitting port of Unit 3 is connected by cable line 46 to the receiving port of Unit 4. The connection back from the transmitting port of Unit 4 to the receiving port of Unit 1 includes a terminator plug 48 at the output of Unit 4, internal dummy lines 50 in each of the four units, cable lines 52, 54 and 56, and a terminator plug 58 at the input of Unit 1. Thus the transmitting port of the last unit in the chain is connected to the receiving port of the first unit in the chain, without requiring an exterior cable.

Figure 4:
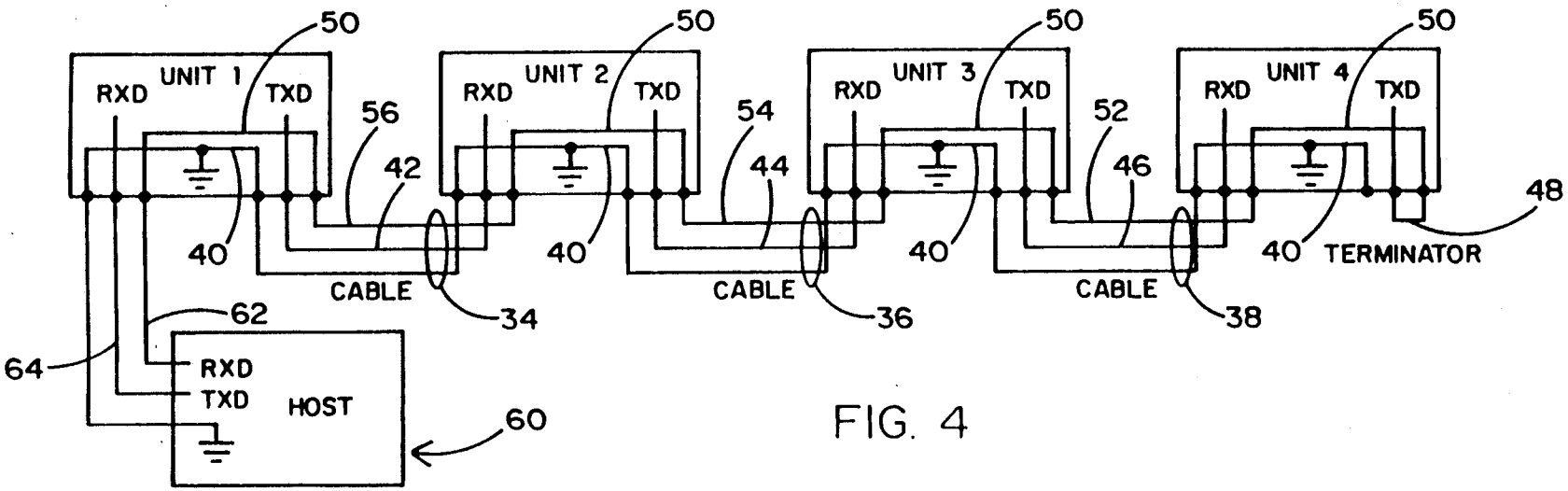
FIG. 4 is similar to FIG. 3, except that it adds a host computer to the hookup.

FIG. 4 shows a hookup similar to that of FIG. 3, except that a host unit 60 is added. In this network, the transmitting port of Unit 4 is connected by lines 50, 52, 54, 56 and 62 to the receiving port of the host unit. And the transmitting port of the host unit is connected by a cable line 64 to the receiving port of Unit 1.

In the electronic portion of each exercise machine, three basic functions are available. The primary function of microprocessor 20 and its connected circuitry is to control and monitor the machine represented by block 22 (FIG. 1). With the addition of the serial communications hardware, two additional functions can be accomplished by microprocessor 20. It can receive and transmit messages pertaining to a racing network. And it can also, if desired, receive information from, and transmit information to, a host computer 60. Such host computer information may, for example, relate to the amount of work done by the user, and to physiological information about the user, such as heart rate. The host computer may also be used to store information for future comparison purposes. The message stream used in the racing function may coexist with a second message stream communicating with the host computer. The host computer passes through all characters which have their high bits set, in order to appear transparent to the racing operations. The messages which the host computer transmits and receives use only ASCII codes, which have their high bits clear.

The racing function does not involve the host computer. As illustrated in FIG. 3, the microprocessor in each exercise unit receives data from the microprocessor in the previous exercise unit in the chain, and transmits data to the microprocessor in the next exercise unit in the chain. Each unit causes its incoming message to pass along to the other units.

If a unit wishes to originate a message, it monitors the message stream and watches for a special character, called the "token," which indicates the end of the stream. Instead of passing the token through, it appends its own message to the stream, and then transmits the token. Once it has sent the message on its way, the originating unit sets an internal flag, in order to remove the next message it receives, which will be the message it originated (assuming the other units in the chain follow the same practice).

This may be better understood if the case of two units is considered. When the network is idle, the two send the token back and forth. If the first unit originates a message, the second unit receives and transmits first the message, then the token. The first unit omits to retransmit the message, and just transmits the token. If both units wish to originate a message, the first one to receive the token sends its message, then the token. The second unit passes along the first message, then a second message, then the token. The first unit passes back the second message and the token; and the second unit passes back just the token.

This procedure may clearly be expanded to any number of exercise units, but each unit adds a processing delay as it detects each character transmitted and monitors the data stream for tokens and messages of interest.

It is also clear that each unit must be able to distinguish the messages sent by the others. For simple applications, a single 8-bit byte might suffice. A better practice is to use messages of fixed length. The approach taken here is to use one, two, and three byte messages, with distinguishing leading characters to indicate the type and length of each message. In describing the flow charts (FIGS. 6–9), the word "character" is used as synonymous with the word "byte".

In the present implementation, when a unit attempts to originate a message, it first determines whether it has ever received a token. If it hasn't, it generates one. As usual, it waits to receive the token before broadcasting its message.

The purpose of the electronic racing network is to allow users of the exercise machines to race against one another. The races are locally generated and managed. In other words, each race is managed interactively by its participants, using the control panels of their respective machines. They collaborate in selecting the length of the race. A racing offer (racing goal) may be electronically made by any participant. Any participant may start a countdown to the race by accepting the current offer. The other participants can join the race at any time during the countdown. After the race begins, the competitors monitor their relative progress until the agreed upon goal is achieved.

The racing procedure is divided into three phases: (1) the setup, during which the racers electronically communicate different goals to one another, and which ends when any racer accepts the current goal, thereby joining the race; (2) the countdown, during which other racers can join; and (3) the race, during which all racers continuously broadcast electronically their progress to the control panels of all machines in the race.

The four types of racing messages circulated through the network are (1) the Token, a single character (byte) which indicates the end of the message stream; (2) the Offer, which is two bytes long and indicates the goal of the race; (3) the Join, which is a single byte including user and race designators; and (4) the Progress message, which is three bytes long and includes the user and race designators and the distance traveled by its originator.

Figure 5:
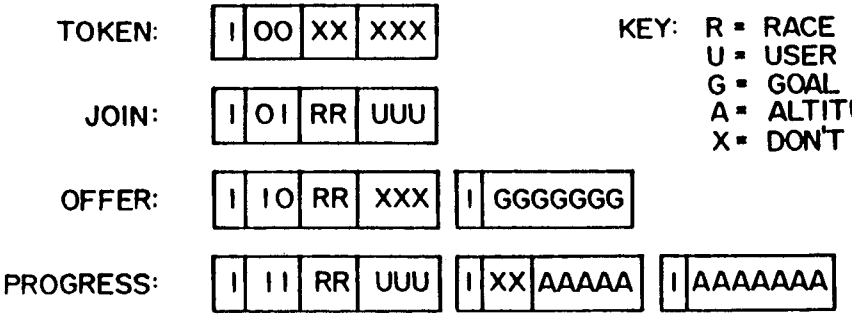
FIG. 5 shows diagrammatically the four types of racing messages.

FIG. 5 illustrates diagramatically the four types of racing messages. The figure includes a key which explains the symbols used in the message bytes. Each byte contains eight bits. The Token message and the Join message each consist of one byte. The Offer message contains two bytes; and the Progress message contains three bytes.

Each byte of each message has its high (most significant) bit set. This allows a separate data stream, with its high bit clear, to be passed through transparently to a host computer for monitoring physiological exercise data. The next two bits (in each byte) indicate the message type and length, with 00, 01, 10, and 11 indicating the Token, Join, Offer and Progress messages, respectively.

The Token has five unused bits (designated "x"). The Join, Offer, and Progress messages each have two bits (designated "R") able to distinguish among separate (up to four) races, which may be conducted simultaneously. Each racer's computer checks the race designator and ignores messages belonging to a different race. Each computer maintains a race counter and increments it (modulo four) at the beginning of each race, in order to assure that each ongoing race has a distinct designator. The designator is included in the Join message in order to maintain synchronization.

The Join and Progress messages each have three bits (designated "U") which are used to distinguish the individual users, i.e., the separate exercise units in the network. Up to eight separate users can be identified in the messages.

The second byte of the Offer message has seven bits (designated "G") which are used to indicate the racing goal, or offer, which is suggested by one of the users. A challenging race for a stair climber might go as high as 4,000 ft. Assuming that the racing goal is offered, and is changed by increasing or decreasing the proposed climbing (racing) distance in increments of 50 ft., the number of possible goals is eighty. Seven bits will accommodate that number of options.

The first byte of the Progress message identifies the race and one of the users involved in the race. The second and third bytes have a total of twelve bits (designated "A") which indicate the altitude reached by the respective user. The maximum altitude is 4,000 ft.; so the number of bits needed is twelve.

Figure 6:
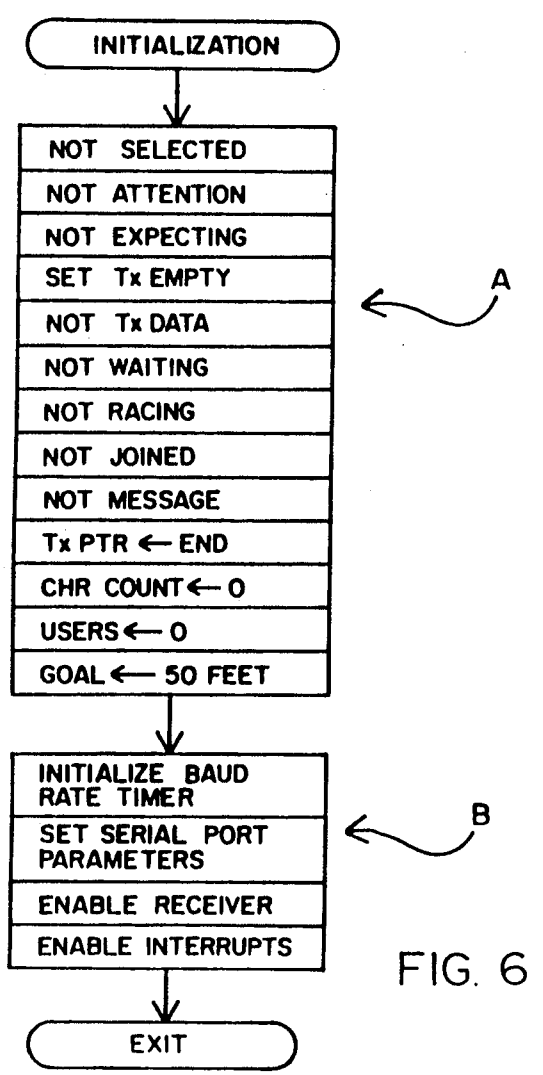

FIGS. 6–9 are flow chart illustrations of the program, which is included in each exercise unit microprocessor, and which controls the racing system. FIG. 6 is headed "Initialization". Its purpose is to show the "idling" status of the software and hardware which exists when the power switch of the exercise unit is turned on. The software establishes the starting conditions listed in the figure. The upper portion, designated "A", shows the status of the software upon initialization. In the software section, the various flags used by the communications routines are cleared or set, and other variables are initialized or zeroed. In the subsequent software flow charts, references to the various flags will be made.

The lower portion, designated "B", shows the status of the hardware (as controlled by the software) upon initialization. In the hardware section, the serial port and the interrupt system are initialized and enabled. In many microprocessors designed for "embedded control", such as the one used in the disclosed system, the serial port hardware is part of the processor; otherwise it would be one or more separate chips. In either case the same procedures would need to be undertaken: the character format parameters must be specified (typically 8 bits, one stop bit, no parity) the communications rate is specified by initializing a counter; and operation is enabled. It is generally more convenient to have the serial port interrupt the processor than to have the processor "poll" the port periodically, but it can be done either way.

The initialization includes nine flags. Only one flag, "TxEMPTY" is set at start up. The other eight flags, "SELECTED", "ATTENTION", "EXPECTING", "TxDATA", "WAITING?, "RACING", "JOINED", and "MESSAGE", are cleared at start up. The software checks the status of a given flag when appropriate, and in certain instances changes its status from clear to set, or from set to clear.

Figure 7A:
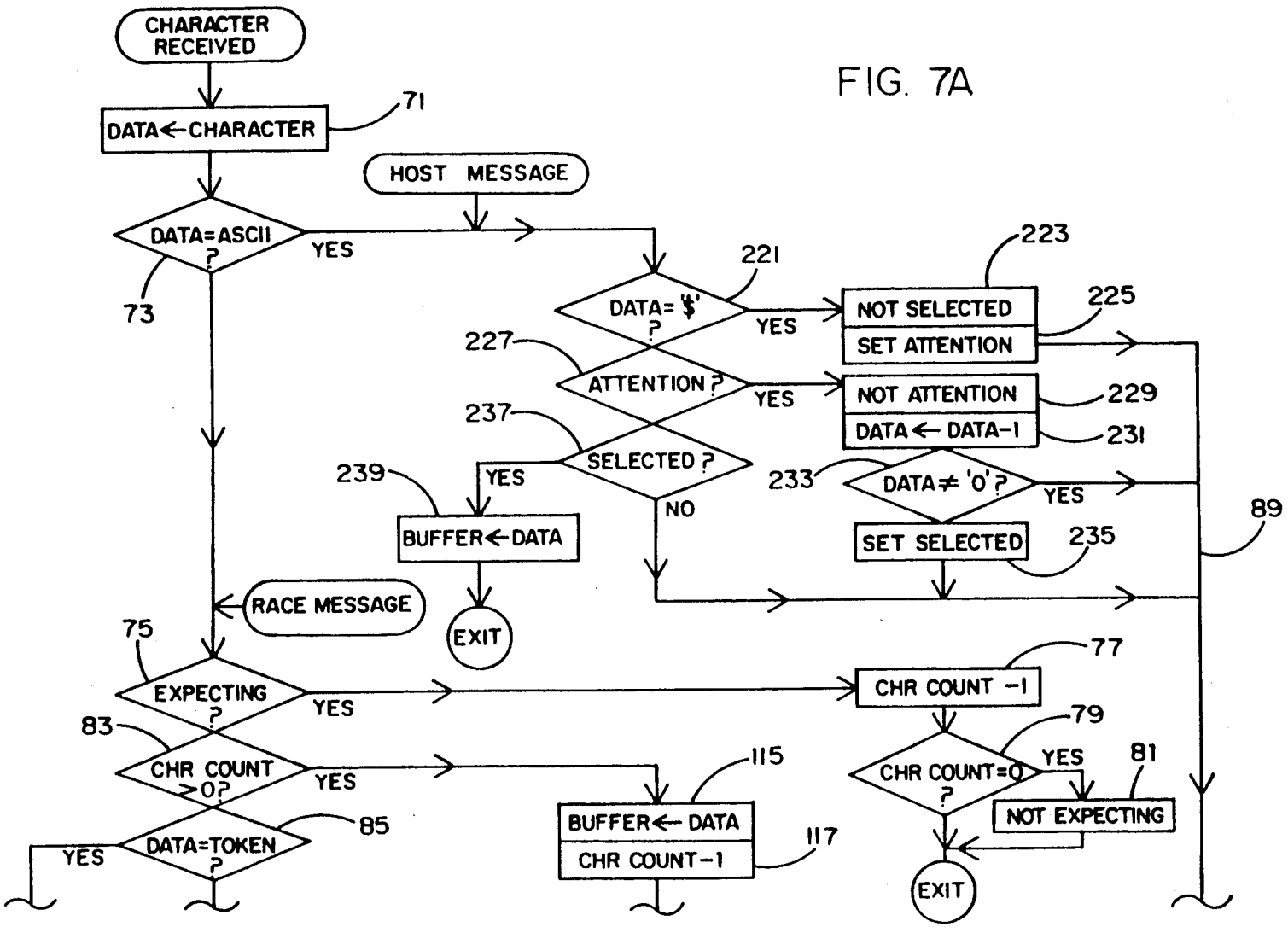
Figure 7B:
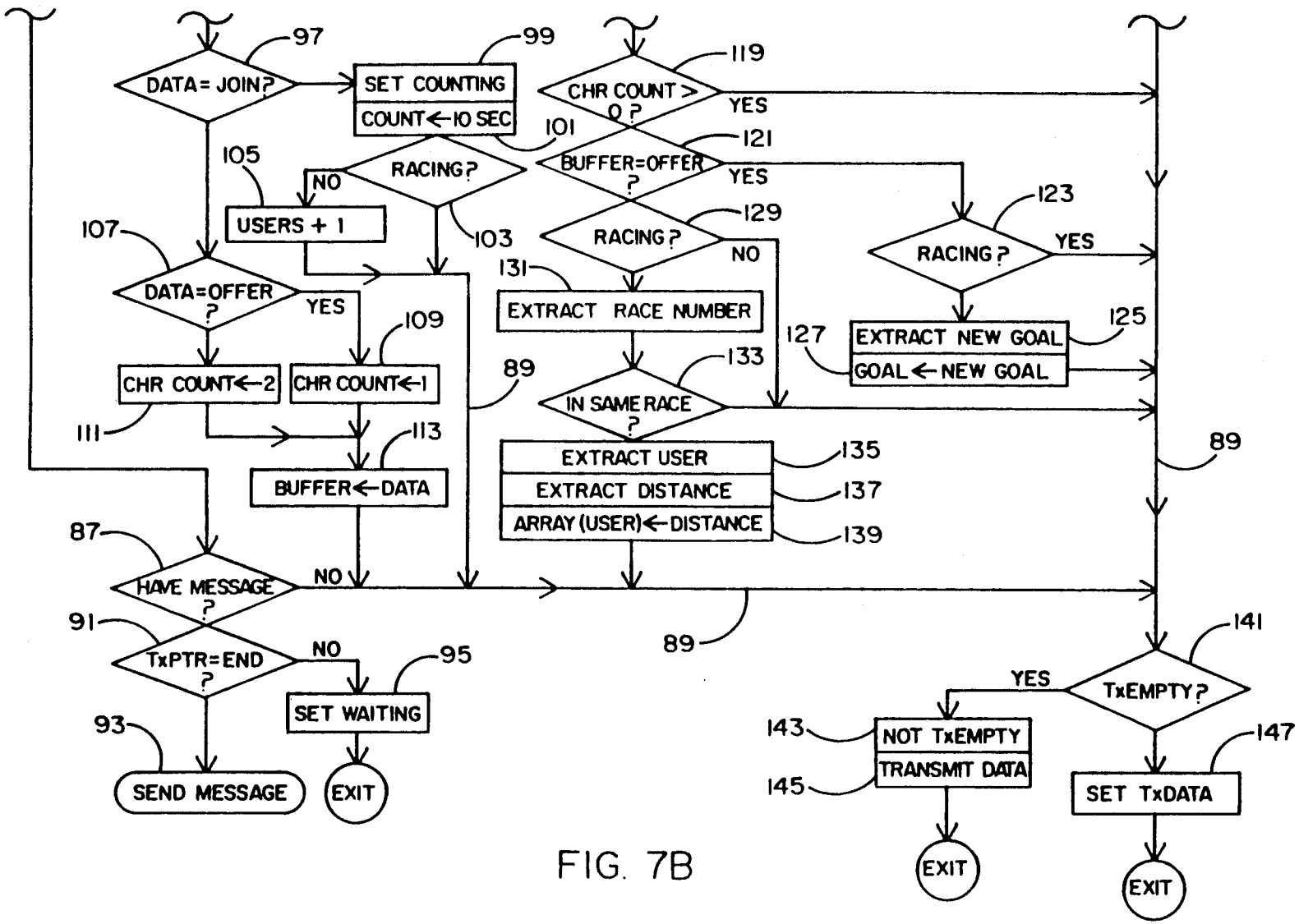

The flow chart in FIGS. 7A and 7B, headed "Character Received", shows what happens when the microprocessor in one machine receives a new character (byte). It first copies the character (process block 71) to a scratch (temporary) register called DATA. (This allows concurrent reception of another character). It then determines (decision block 73) whether the character is ASCII, that is, whether its high bit is clear. If so, execution branches to the procedure labeled "HOST MESSAGE" (described below). If the decision at block 73 is negative, execution branches to the "Race Message" procedure.

The first question (decision block 75) in the "Race Message" procedure is whether the EXPECTING flag is set. This flag is set and the CHR (Character) COUNT variable is initialized when the machine itself has originated a message, and is responsible for removing it from the message stream. As explained above, the CHR Count (number of bytes) may be 1, 2, or 3. If the flag is set, CHR COUNT (process block 77) is decremented. When the count reaches zero (decision block 79), the EXPECTING flag is cleared (process block 81). In either case, i.e., either a "yes" or "no" decision at block 79, the procedure exits, and the character is not passed along.

If decision block 75 indicates that a message is not expected, the question is asked (decision block 83) whether the Character Count is greater than zero. At initialization, as shown in FIG. 6, the Character Count was set at zero. Therefore, immediately after initialization, the answer at block 83 will be "no," i.e., the existing Character Count is zero.

Since the CHR COUNT variable at initialization is zero, the DATA character (block 71) is the beginning of a message and is examined directly. If it is a Token (decision block 85), the question is asked (decision block 87) whether a waiting flag has been set, indicating that the machine has a message it wishes to transmit. If the answer is "no", return line 89 is taken, i.e., the Token is passed along. If the answer at block 87 is "yes", decision block 91 is reached.

Figure 8:
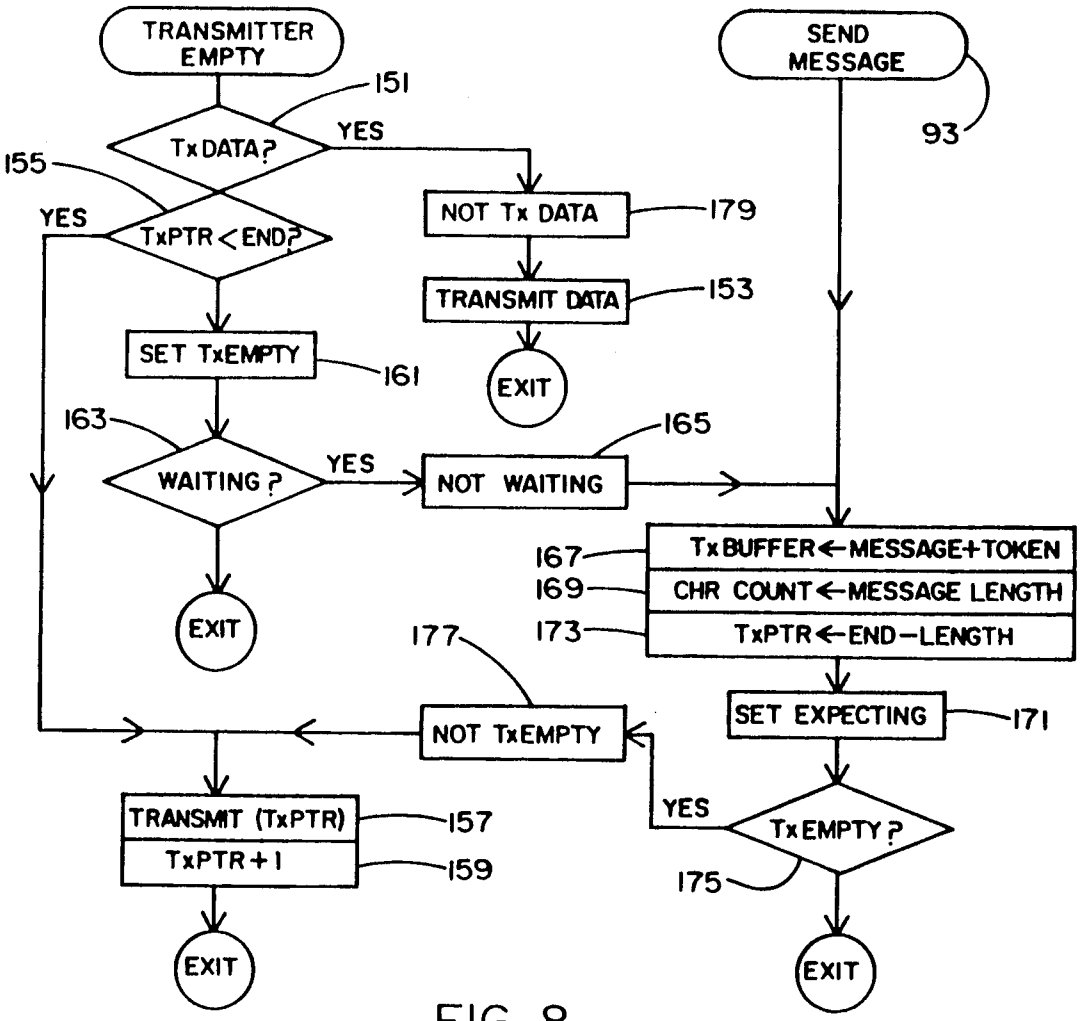
FIGS. 6-9 are flow charts showing the software control of the racing function.

The terms in decision block 91 and in process block 95 appear in the flow chart of FIG. 8. The term TxPTR means "transmitter pointer". The transmitting port of the microprocessor has a buffer memory which will be empty, i.e., will be at "end", if no other message is passing through at the time. If the answer at block 91 is "yes", the message initiated by the exercise unit is sent (block 93). If the answer at block 91 is "no", the waiting flag is set at process block 95 so that the sending of the message will be temporarily postponed.

If DATA isn't the Token (decision block 85), it might be a Join (decision block 97), in which case the COUNTING flag is set (process block 99) and the COUNT variable (process block 101) is set to ten seconds. At decision block 103, it is determined whether the unit is racing (has the racing flag been set). If it is not RACING, the USERS variable (the number of racers joining the current race) is incremented at process block 105. The common return 89 is taken after either "yes" or "no" at block 103.

If the Data is neither a Token nor a Join, it could be an Offer (decision block 107), in which case one further character will arrive, so CHR COUNT is set to one (process block 109). Otherwise it must be a Process message, and two more characters are expected, so CHR COUNT is set to two (process block 111). In both cases, DATA is copied to a buffer (process block 113), and the common return 89 is taken.

Returning to decision block 83, a "yes" answer, indicating that CHR (Character) Count already is greater than zero, signifies that a message is being assembled. The DATA from block 71 is copied into a buffer (at process block 115), and the count is decremented (at process block 117). If CHR COUNT (at decision block 119) is greater than zero, more data remains, and the return line 89 is taken. Otherwise the message is complete and can be examined.

If the buffer contains an Offer (decision block 121), and if the RACING flag is set (decision block 123), the return line 89 is taken. The machine is in a race and already has a goal. Otherwise the new goal is extracted from the buffer (process block 125), copied into the GOAL variable (process block 127), and the return line 89 is taken.

If the answer at decision block 121 is "no", i.e., the message in the buffer is not an Offer, the buffer must contain a Progress message. (The single character Join message has been handled upon reception, and the two character Offer message has been denied). If the RACING flag is set (decision block 129), the race number is extracted from the message (process block 131) and compared to the machine's own race number (decision block 133). If they are the same, the user number and distance are extracted, and the distance is copied into the appropriate place in an array of distances (process blocks 135, 137 and 139).

Execution now reaches the common return 89, in which the received character is transmitted down the line. The flag TxEMPTY is set when the transmitter is idle. If it is set (decision block 141), it is cleared and DATA is copied directly into the transmitter (process blocks 143 and 145); otherwise the TxDATA flag is set (process block 147). In either case, the procedure exits.

FIG. 8 has two heading blocks "TRANSMITTER EMPTY" and "SEND MESSAGE". The latter has numeral 93 to indicate its correspondence to block 93 in FIG. 7. The Transmitter Empty procedure executes when the machine finishes transmitting a character. The TxDATA flag is checked (decision block 151); if the flag is set, DATA is transmitted (process block 153) and an exit is made. At process block 179, the TxDATA flag is cleared. If the answer at block 151 is "no", the TxPTR variable is checked (decision block 155). "PTR" is an abbreviation of "pointer". If TxPTR is not at "end", indicated by a "yes" answer at block 155, then it is pointing into the transmitter's message buffer; and the character at that position in the buffer is transmitted (process block 157) TxPTR is advanced (process block 159), and the procedure exits.

Otherwise the TxEMPTY flag is set (process block 161) to indicate that the transmitter is idle. If the waiting flag is set (decision block 163), indicating that the token has been received and a message is waiting, the waiting flag is cleared (process block 165) and the SEND MESSAGE routine executes. Otherwise the procedure exits.

In SEND MESSAGE, the new message is copied into TxBUFFER with the token appended (process block 167); the variable CHR COUNT is set to the length of the message (process block 169); the EXPECTING flag is set (process block 171); and TxPTR is set to the beginning of the message (process block 173).

At decision block 175, it is determined whether the TxEMPTY flag is set (process block 161). If the answer is "yes", the flow moves to process blocks 157 and 159, where the first character in TxPTR is transmitted, and TxPTR is advanced. Note that the "yes" message from block 175 causes the TxEMPTY flag to be cleared (process block 177). If the answer at block 175 is "no", the procedure exits. It should be noted that both the receiver and transmitter routines are interrupt handlers. The transmitter causes an interrupt when it empties, notifying the microprocessor that another character can be sent. If there is nothing further to send (decision block 155), there will be no further interrupts. The TxEMPTY flag is then set (process block 161), so that other routines which generate new messages can examine it and resume transmission.

Figure 9:
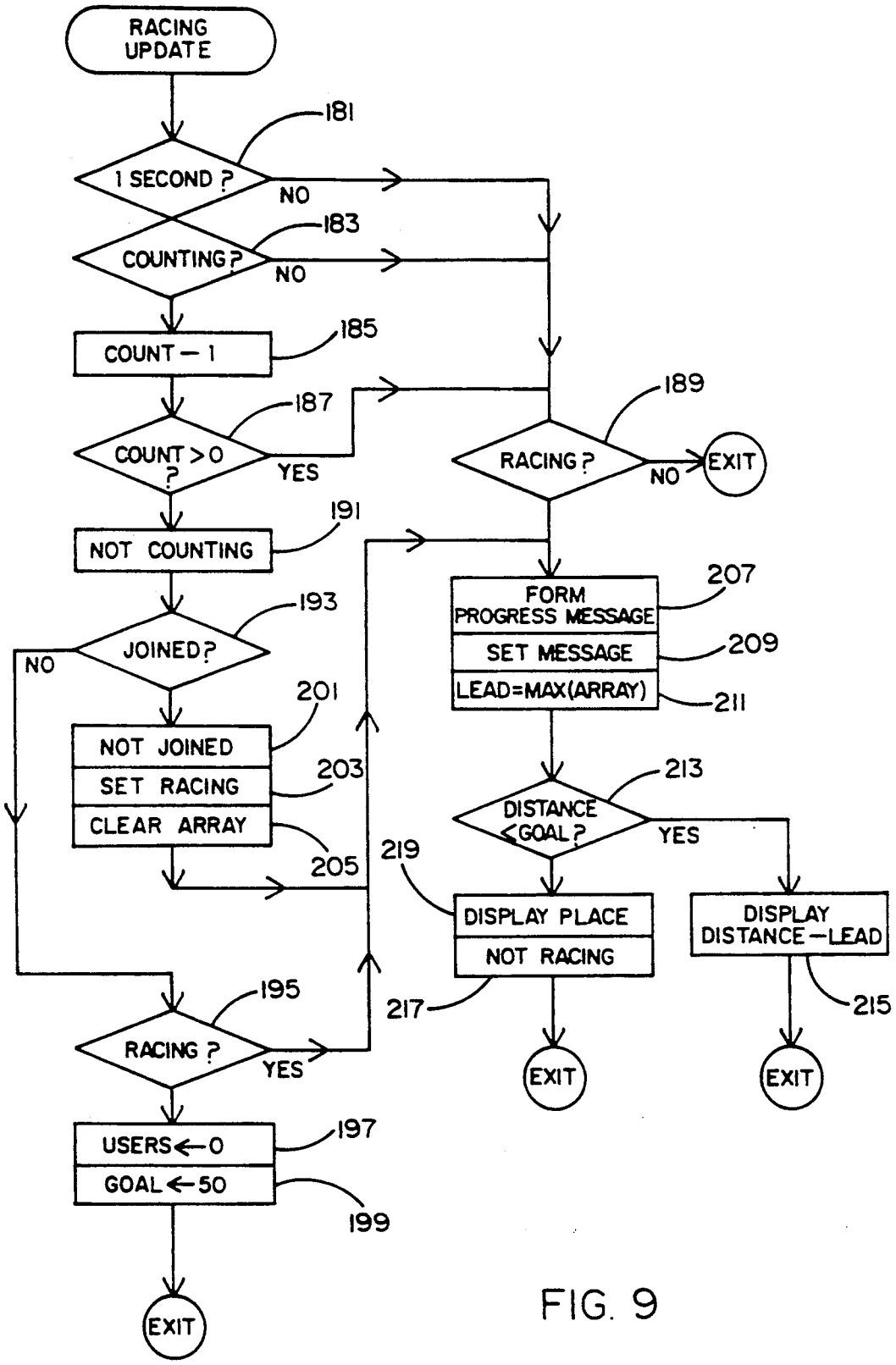

FIG. 9, headed "RACING UPDATE", shows a routine which is executed every fifty milliseconds. It has two main sections, one handling the countdown to the beginning of a race, and the other handling information during a race. The first two questions are whether this is a one second period (block 181), and whether the unit is counting down (block 183). If either condition is false, the countdown section is skipped. Otherwise, the COUNT variable (process block 185) is decremented. If the count has not reached zero (block 187), execution continues at the RACING question (block 189) at the top of the racing section. If the racing flag is not set, an exit is made.

If the COUNT has reached zero (block 187), a race has started. The counting flag is cleared (process block 191); and the JOINED flag, which indicates that the machine's user has joined the race, is checked (decision block 193). If the answer block at 193 is "no", the next question is whether the user is in a different race, as signified by its RACING flag (decision block 195). If the user is in a different race, the chart branches directly into the racing procedure. Otherwise the USERS variable is zeroed (process block 197) and the GOAL of the unit is set at fifty feet (process block 199), which is the default value.

If JOINED was set (block 193), the JOINED flag is cleared (block 201) and the RACING flag is set (block 203). The array of competitors' distances is cleared (block 205), and execution continues in the racing section.

The Progress message is then formed (process block 207) and the MESSAGE flag is set (process block 209), so that when a Token is next received the message will be dispatched. Next the value LEAD is calculated as the maximum over the array of competitors' distances (process block 211). The user's distance is compared to the goal; if less than the goal (decision block 213), the difference between the user's and the leader's distances is displayed (process block 215). Otherwise the user has finished the race. The RACING flag is cleared (process block 217) and the user's place is displayed (process block 219).

Figure 11:
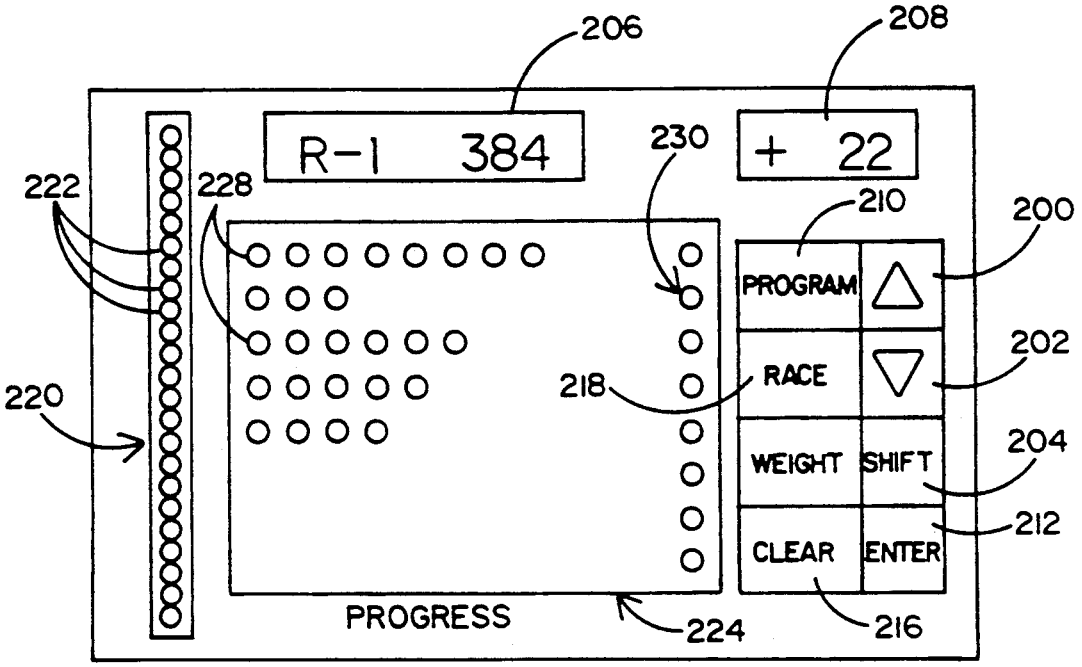
FIGS. 10 and 11 are plan views of the display panel of each exercise unit, FIG. 10 showing the display as it appears in the ordinary (non-racing) mode.
Figure 10:
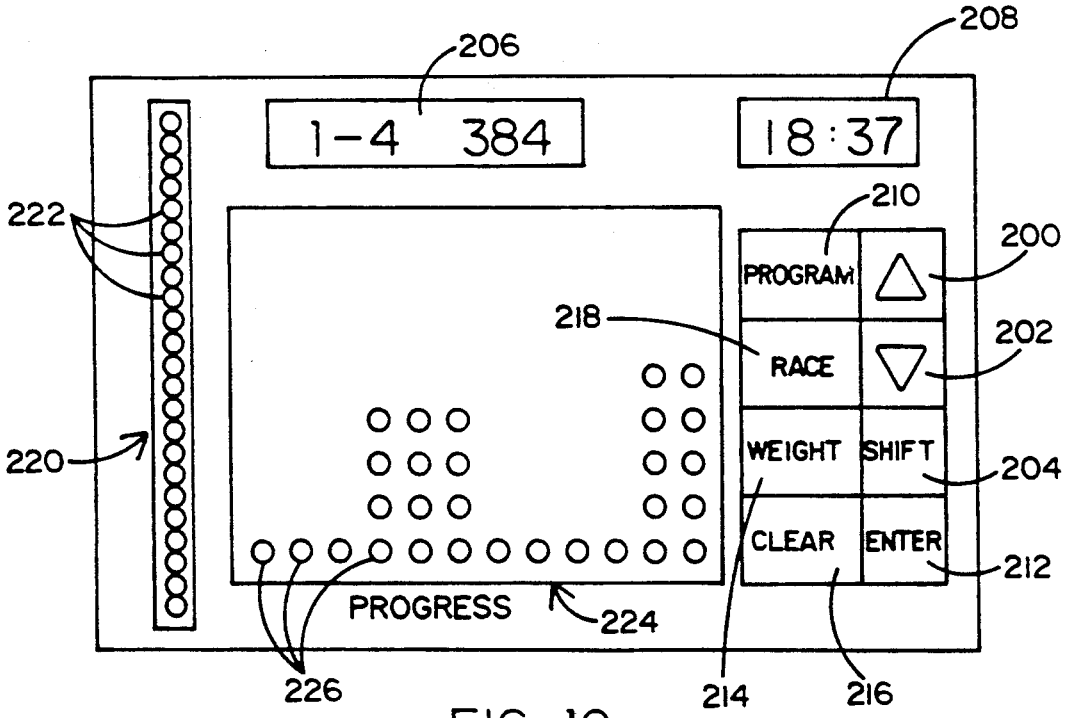

FIGS. 10 and 11 show the display panel of the machine in two modes. FIG. 10 illustrates the non-racing mode; and FIG. 11 illustrates the racing mode. The same display lights are able to handle both modes. The normal program display is shown in FIG. 10. It has eight command keys at the right side. Key 200, having an upwardly pointing arrow, is pressed when the user desires to increase the machine speed. Key 202, having a downwardly pointing arrow, is pressed when the user desires to decrease the machine speed. "Shift" button 204 changes the display readouts back and forth between (1) program/level, calories per hour, and time remaining; and (2) distance, calories, and elapsed time. The program chosen, and its effort level are displayed (1–4) in the left portion of window 206. The other numeral in window 206 (384) represents calories per hour. The time remaining (18:37) is shown in window 208.

A program key 210 causes the selected program to be displayed in windows 206 and 208. The user may adjust the program over a wide range of possibilities. Pressing "Enter" key 212 causes the program to begin. Key 214 permits the user to enter his/her weight, in order to provide an accurate calorie readout. "Clear" key 216 is used to clear the display or quit a program.

A "Race" key 218 permits the user to set up and participate in a race. In other words, it permits the user to control the software and microprocessor in the manner previously described in this application. Pressing the "Race" key causes the display to show the offered racing goal, in feet, if a race has not started. Any user may suggest a different goal by pressing key 200 or key 202. Or any user may accept the displayed goal by pressing "Enter" key 212. As soon as any user has accepted a racing goal, a countdown of 10 seconds is displayed, during which any other user may enter the race by pressing the "Enter" key on that user's machine.

Once a race is underway, the number of the race in which the machine is entered is shown in window 206 (Race 1 in FIG. 11). The number in window 208 (22 in FIG. 11) shows the distance (in feet) to the nearest competitor. Because the number in FIG. 11 is positive, the display shown must be the leader's display.

A lighted display is provided to enhance the information available to the user. A column 220 of light units, e.g., LEDs 222, at the left of the display panel, functions as a speedometer. This column has a number of blinking lights energized to show the current speed of the machine. The higher the lighted column, the higher the speed. The distance from one LED 222 to the next represents a predetermined speed increment, e.g., 5 feet per minute in a stair climber. Although 23 LED units are shown in the figure, the actual apparatus has 29 such units.

A window 224, under which the word "PROGRESS" appears, is of primary interest in the racing mode. This window has a number of horizontal rows of light units (e.g., LEDs) and a number of vertical columns of such lights, e.g., 8 rows and 12 columns. In the actual apparatus, an array of $8 \times 15$ LEDs is used. In the normal (non-racing) mode, shown in FIG. 10, the lighted height of each column 226 represents a speed, with the full available height representing the maximum speed. The left column represents current speed, as determined by the program. Each successive column toward the right represents a speed value which the program will create in the future. Periodically, at intervals of, say, 5 seconds, the columns will shift to the left. The prior left column will disappear, and a new column will appear at the right. The user can anticipate changes in the programdemanded speeds.

In FIG. 11, using the available $8 \times 12$ light unit array, the progress of an ongoing race is displayed. Each row 228 of lighted units represents the position of a different racer. In the illustration, 5 racers are involved, represented by the 5 top rows. The leader is represented by the top row. The lighted column 230 at the right represents the finish of the race.

Certain flow chart functions in FIG. 7 remain to be described. They pertain to situations in which the electronic communications are not related to racing, but to the functions of a host computer, such as unit 60 in FIG. 3. The host computer selects a given machine for further operations by sending the ASCII representation of a dollar sign followed by a digit. For example, "$1" selects the first machine in the chain, "$2" selects the second machine, and so forth.

Each machine in the chain checks the characters received, and upon detecting the "$", character sets a flag. When the next character is received, each machine decrements it, passes it along, and checks for the character "0", indicating that a "1" was received. If it was, it becomes the selected unit and responds to further host messages. Otherwise it ignores further host characters until the next "$" is received.

If the host receives a "$" followed by a character less than a digit, it concludes that a machine has accepted selection, and begins direct communication with it. If it receives a "$" followed by a digit, it concludes that it has attempted to address a non-existent or non-participating machine. The host can thus determine for itself how many machines are in the loop.

Referring to FIG. 7, a "yes" answer at block 73 causes the execution to branch to the procedure labeled "HOST MESSAGE". The first question (decision block 221) in the "HOST" procedure is whether the character is the selection prefix "$". If it is, the machine clears its SELECTED flag (process block 223), sets the ATTENTION flag (process block 225), and continues to the main return line 89 at the right of the chart, which eventually leads to the character being passed down the chain.

If the character at block 221 isn't "$" the next question (decision block 227) is whether the ATTENTION flag is set—in other words, whether the previous character was "$". If the ATTENTION flag is set, it is cleared (process block 229), the character is decreased by one (process block 231), and, if it is not "0" (decision block 233), the SELECTED flag is set (process block 235). In either case execution continues to the main return line 89.

If the character isn't "$" (block 221) and the ATTENTION flag isn't set (block 227), the SELECTED flag is checked (decision block 237). If that flag isn't set either, execution continues to the main return 89 (the character is passed along and ignored). If the SELECTED flag is set, the character is copied to a buffer (process block 239) for the main routine to examine, and execution terminates (the character isn't passed along).

From the foregoing description, it will be apparent that the software and hardware disclosed in this application will provide the significant functional benefits summarized in the introductory portion of the specification.

The following claims are intended not only to cover the specific embodiments and methods disclosed, but also to cover the inventive concepts explained herein with the maximum breadth and comprehensiveness permitted by the prior art.

What is claimed is:

1. A racing network of exercise machines in which each machine has its own embedded computer for machine control purposes, and in which racing functions are controlled by such machine embedded computers, comprising:

means for providing intercommunication among the machine-embedded computers without intervention of a non-embedded computer;

each machine embedded computer including all of the following:

means for offering a racing goal to the other embedded computers;

means for accepting a racing goal offered by another embedded computer;

means responsive to such an acceptance for starting a race;

means for transmitting to the other embedded computers the information disclosing the racing progress of the machine containing the transmitting computer; and means for receiving from the other embedded computers information disclosing the racing progress of each machine involved in the race.

2. The exercise machine network of claim 1, which also comprises:

means for displaying at each machine in the race the positions in the race of all machine sin the race.

3. The exercise machine network of claim 1 which comprises:

means for permitting a plurality of unrelated races to be conducted simultaneously.

4. The exercise machine network of claim 1, in which each embedded computer has a transmitting port connected to a receiving port of a second embedded computer, and a receiving port connected to a transmitting port of a third embedded computer.

5. The exercise machine network of claim 1, which also comprises:

a host computer separate from the embedded computers; and means for transmitting to, and receiving from, the host computer messages other than racing-related messages.

6. In a network of exercise machines, each of which has an embedded microprocessor which controls its machine in accordance with user-created command signals and machine-created feedback signals, each such microprocessor having an input port and an output port for communication with other microprocessors, a method of providing racing options for the users of the respective machine, comprising:

permitting each user to initiate a racing offer at the user's microprocessor;

transmitting that offer to the other microprocessors in the network;

allowing each user to accept or change a racing offer from another user;

allowing each user to initiate a race by accepting the then current racing offer;

allowing each user to join or not join a race which has been offered and accepted;

compiling at each microprocessor the information disclosing the progress of its machine in an ongoing race; and conveying such information from the microprocessor in each machine to all other machine embedded microprocessors in the network.

7. The method of claim 6 which also includes the steps of:

entering racing information from the network only in those microprocessors engaged in the same race; and displaying visually the positions for all users involved in a given race at the exercise machine of each such user.

8. The method of claim 6 which also includes:

permitting users not engaged in a given race to initiate and engage in a separate concurrent race.

9. An exercise machine having a microprocessor which includes (a) means for receiving user command signals and machine feedback signals, and (b) means for communicating with one or more microprocessors included in similar exercise machines, the microprocessor having hardware and software for racing, comprising:

means for electronically receiving and transmitting racing messages in communication with the other microprocessor(s);

means for electronically initiating racing messages, including the suggesting of a goal for a proposed race to the other microprocessor(s);

means for electronically responding to racing messages, including the accepting via the microprocessor of a racing goal proposed by another microprocessor;

means for electronically synchronizing the start of a race in response to an acceptance of a suggest racing goal;

means for exchanging racing information with the other microprocessor(s) disclosing their relative positions in an ongoing race; and means for displaying such information so that each user's position in an ongoing race is readily apparent.

10. The exercise machine and microprocessor of claim 9 which also comprises:

means for electronically responding to a proposed racing goal from another microprocessor by raising or lowering the goal in predetermined increments.

11. The exercise machine and microprocessor of claim 9 in which the racing messages which the microprocessor may initiate or respond to include a token message, an offer message, a join message, and a progress message.

12. The exercise machine and microprocessor of claim 11 in which the token and join messages are each conveyed by one 8-bit character, the offer message by two 8-bit characters, and the progress message by three 8-bit characters.

13. The exercise machine and microprocessor of claim 9 which also comprises:

means for providing a non-racing message stream connected by any microprocessor; and means for causing the signals at each microprocessor to provide either a racing message stream or a non-racing message stream.

14. The exercise machine of claim 9 which simulates stair climbing and which also comprises:

means for causing the exercise machine to substantially maintain a selected climbing speed; and means under control of the machine user for selecting at any time a different climbing speed.

15. The exercise machine and microprocessor of claim 14 which also comprises:

means for responding to a proposed racing goal from another microprocessor by raising or lowering the goal in predetermined vertical distance increments.

16. A method for racing an exercise machine having a microprocessor which includes (a) means for receiving user command signals and machine feedback signals, and (b) means for communicating with one or more microprocessors included in similar exercise machines, the microprocessor having hardware and software for racing, said method comprising:

receiving and transmitting racing messages in communication with the other microprocessor(s);

initiating racing messages, including the suggesting of a goal for a proposed race to the other microprocessor(s);

responding to racing messages, including entering or changing a race proposed by another microprocessor;

exchanging racing information with the other microprocessor(s) disclosing their relative positions in an ongoing race; and displaying such information so that each user's position in an ongoing race is readily apparent.

17. The method of claim 16 which also comprises:

responding to a proposed racing goal from another microprocessor by raising or lowering the goal in predetermined increments.

18. The method of claim 16 in which the racing messages which the microprocessor may initiate or respond to include a token message, an offer message, a join message, and a progress message.

19. The method of claim 18 in which the token and join messages are each conveyed by one 8-bit character, the offer message by two 8-bit characters, and the progress message by three 8-bit characters.

20. The exercise machine network of claim 1 in which the machines simulate stair climbing, each of which machines comprises:

means for causing the exercise machine to substantially maintain a selected climbing speed; and means under control of the machine user for selecting at any time a different climbing speed.

21. An exercise machine network comprising:

a plurality of independently controlled machines, each including an embedded machine-controlling computer and serial communications means having input and output ports connected to the embedded computer;

means for connecting the output port of each machine to the input port of the next machine in the network, with the output of the last machine connected to the input of the first;

means in each embedded computer for receiving and transmitting electronic messages one after the other in a stream which continues on the same path through the network of computers; and message altering means in each embedded computer capable of altering the message stream before it is transmitted to the next embedded computer.

22. The exercise machine network of claim 21 in which each embedded computer includes:

means for originating messages and including them in the message stream; and means for removing messages from the message stream.

23. The exercise machine network of claim 22 in which each embedded computer (a) echoes any message which it did not originate, (b) appends any message it originates to the end of the stream, and (c) removes its own originated message after that message has made one pass through the network.

24. The exercise machine network of claim 22 in which:

each message stream includes a termination signal which indicates the end of the message stream; and means for altering the portion of the message stream which immediately precedes the termination signal.

25. The exercise machine network of claim 21 which also comprises:

a host computer; and means for electronically connecting the host computer to the embedded computers.

* * * * *

UNITED STATES PATENT AND TRADEMARK OFFICE

CERTIFICATE OF CORRECTION

PATENT NO. : 5,089,960

DATED : February 18, 1992

INVENTOR(S) : Sweeney

It is certified that error appears in the above-identified patent and that said Letters Patent is hereby corrected as shown below:

On the title page: Change the Title of this Patent from "Racing System For Exercise Machines" to -- System For Allowing Communication Among Exercise Machines --.

Column 1, first line: Change the title of this Patent from "Racing System For Exercise Machines" to -- System For Allowing Communication Among Exercise Machines --.

Column 13, line 41: Change "by" to -- to --.

Signed and Sealed this

First Day of June, 1993

*Attest:*

Michael K. Kirk

MICHAEL K. KIRK

*Attesting Officer*

*Acting Commissioner of Patents and Trademarks*